US007685685B2

(12) United States Patent
Giampavolo

(10) Patent No.: US 7,685,685 B2
(45) Date of Patent: Mar. 30, 2010

(54) SEAT BELT WITH CHILD RESISTANT BUCKLE

(76) Inventor: Paul Giampavolo, 9 Hasta Way, Newton, NJ (US) 07860

( * ) Notice: Subject to any disclaimer, the term of this patent is extended or adjusted under 35 U.S.C. 154(b) by 0 days.

(21) Appl. No.: 10/639,964

(22) Filed: Aug. 11, 2003

(65) Prior Publication Data

US 2004/0134046 A1 Jul. 15, 2004

Related U.S. Application Data

(63) Continuation-in-part of application No. 09/952,070, filed on Sep. 13, 2001, now Pat. No. 6,604,265.

(60) Provisional application No. 60/232,546, filed on Sep. 14, 2000, provisional application No. 60/421,932, filed on Oct. 28, 2002.

(51) Int. Cl.
*A44B 11/25* (2006.01)

(52) U.S. Cl. ..... 24/614; 24/615; 24/625

(58) Field of Classification Search ..... 24/615, 24/614, 625
See application file for complete search history.

(56) References Cited

U.S. PATENT DOCUMENTS

| | | | | | |
|---|---|---|---|---|---|
| 4,637,622 | A | * | 1/1987 | Burgard | 280/33.993 |
| 4,991,272 | A | * | 2/1991 | Bianchi | 24/616 |
| 5,263,726 | A | * | 11/1993 | Wood | 280/33.992 |
| 5,307,544 | A | * | 5/1994 | Quarberg et al. | 24/633 |
| 5,311,649 | A | * | 5/1994 | Suh | 24/625 |
| D359,464 | S | | 6/1995 | Grasso et al. | |
| 5,465,472 | A | * | 11/1995 | Matoba | 24/625 |
| 5,546,642 | A | | 8/1996 | Anscher | |
| 5,641,200 | A | * | 6/1997 | Howell | 297/256.17 |
| 5,659,931 | A | | 8/1997 | Anscher | |
| 5,791,026 | A | * | 8/1998 | Anscher | 24/615 |

(Continued)

FOREIGN PATENT DOCUMENTS

| | | |
|---|---|---|
| JP | 08-84610 | 4/1996 |

(Continued)

OTHER PUBLICATIONS

United Kingdom Department of Trade and Industry publication titled "Assessment of broad age-related issues for package opening", "Appendix 1: A case study—child resistant closure" prepared by Dr. Laxman Nayak, Mar. 1999 (This document can also be view at http://www.broadband.gov.uk/homesafetynetwork/pdf/packopen.pdf).*

*Primary Examiner*—Robert J Sandy
(74) *Attorney, Agent, or Firm*—Weingartem, Schurgin, Gagnebin & Lebovici LLP

(57) ABSTRACT

A seatbelt assembly with a buckle has male and female mating parts, in which the male part includes features to prevent disengagement operation by a child. The child resistant features include added ribs, webbing in the form of flanges or struts, or barbs or prongs that increase the difficulty for disengaging the buckle. The female part can have an arcuate outer surface to increase the overall durability of the buckle and resist damaging external forces or damaging misuse. The female part can also be provided with lateral shoulders to make the female part harder to withdraw and thus more child resistant. The seatbelt assembly with the child resistant buckle can be operated easily by an adult, while remaining secure from disengagement by a typical child.

68 Claims, 8 Drawing Sheets

U.S. PATENT DOCUMENTS

| | | | | | |
|---|---|---|---|---|---|
| 5,794,316 | A | * | 8/1998 | Anscher | 24/625 |
| 5,855,057 | A | | 1/1999 | Anscher | |
| D405,723 | S | | 2/1999 | Anscher | |
| 6,052,875 | A | * | 4/2000 | Fudaki | 24/625 |
| 6,145,172 | A | * | 11/2000 | Bourdon | 24/625 |
| 6,148,486 | A | | 11/2000 | Uchara et al. | |
| 6,263,549 | B1 | * | 7/2001 | Uehara | 24/625 |
| 6,684,466 | B2 | | 2/2004 | Nishida et al. | |
| 2003/0110605 | A1 | * | 6/2003 | Nishida et al. | 24/615 |
| 2003/0140461 | A1 | * | 7/2003 | Wilcock | 24/191 |

FOREIGN PATENT DOCUMENTS

| | | | |
|---|---|---|---|
| JP | 2001-61514 | | 3/2001 |
| WO | WO 84/01275 | * | 4/1984 |

* cited by examiner

SEAT BELT WITH CHILD RESISTANT BUCKLE

RELATED APPLICATIONS

This application is a Continuation-In-Part of application Ser. No. 09/952,070, filed Sep. 13, 2001 now U.S. Pat. No. 6,604,265, entitled CHILD RESISTANT BUCKLE, and is based upon and claims benefit of Application No. 60/232,546, filed Sep. 14, 2000, entitled CHILD RESISTANT BUCKLE, and is based upon and claims benefit of application No. 60/421,532, filed Oct. 28, 2002, to each of which a claim of priority is hereby made.

BACKGROUND OF THE INVENTION

The present invention is directed to a child seatbelt assembly with a child resistant buckle and, in particular, to an improvement in the type of buckle commonly used in many children's safety seats, strollers, baby carriages, shopping cart seat belts, etc. A prior art buckle for use with a seatbelt assembly is made, for example, by Illinois Tool Works (ITW) and others and is well known. Referring to FIG. 9A, a prior art buckle has two latch members 10 of a male part 20 that slide into a slot 12 of a female part 30 and have barbed ends 14 that engage in female pan 30. The prior art buckle can be manipulated, by some young children, in a way that permits the buckle to be undone. As is well known, the two barbed ends 14 are pressed toward each other to allow male part 20 of the buckle to be removed from female part 30.

Others have attempted to provide a child resistant buckle for use with a seatbelt assembly. For example, see Gallbreath, U.S. Pat. No. 5,991,985 which provides a third fastening element and includes a depressable button to allow the third fastening element to be undone. This buckle is cumbersome because it requires that the user learn an additional motion in order to undo the buckle, i.e., the user must at the same time depress the side latches and the center button to undo the buckle and release the seatbelt strap.

Retainer strap seatbelt assemblies with conventional buckles are disclosed in U.S. Pat. Nos. 6,101,687 and 6,101,690, which are incorporated herein by reference in their entireties. These seatbelt assemblies are typically used in shopping carts to help restrain children in the carts and prevent injury. However, the buckles in these seatbelt assemblies are not designed to be child resistant to any certain extent.

Indeed, no readily adoptable standard for child resistant buckles is presently available. However, because of the importance of providing a child resistant buckle, it would be desirable to provide a buckle that is not easily opened by children under a certain age, for example 4 years old, but is readily opened by adults or older minors, for example, of 16 years of age or older.

An example of a child resistant buckle in a seatbelt assembly is found in U.S. patent application Ser. No. 10/081,353, the entire disclosure of which is hereby incorporated into the present application by reference. The buckle includes a number of features to increase the child resistant properties of the buckle. However, there is no readily available data that suggests one design is more appropriate for providing child resistant properties than another design.

Moreover, when the types of buckles and straps described above are used in an environment where the buckles are typically subjected to high impact and compression forces, the buckle can be damaged. A typical application for the buckles and straps are on child safety restraints, or seatbelts, used on grocery shopping carts. When carts are nested together with one another for storing large numbers of carts easily, for example, the buckles can be caught between the carts and can be subjected to high impact and compressive forces. Impact forces like these tend to cause the buckle to crack or even shatter. Compressive forces can deform the buckle beyond a point of elastic resilience, resulting in an unworkable buckle. In addition, if it is desired that the buckle exhibit certain features, such as child resistance, the forces applied to the buckle should not disrupt the desired features.

In addition, the seatbelt assembly is sometimes misused in connecting grocery carts together, for example, to tow a number of carts together. These occasions of misuse can produce high tensile strain on the buckle, causing the buckle to fail and resulting in damage to buckle components.

SUMMARY OF THE INVENTION

It is an object of the present invention to overcome the drawbacks associated with the prior art.

It is a further object of the present invention to provide a seatbelt assembly with a child resistant buckle while maintaining design and operating features similar to those provided in the prior art and simplicity of operation.

It is a further object of the present invention to provide a seatbelt assembly that is resistant to high tensile, impact and compressive forces.

Briefly stated, according to the present invention there is provided a seatbelt assembly with a buckle with male and female mating parts, in which the male and female parts include features to prevent disengagement operation by a child. The child resistant features include added ribs, webbing in the form of flanges or struts, or barbs or prongs that increase the difficulty for disengaging the buckle. The force to disengage the buckle is set at a threshold level that is above a force level that a child can exert on the buckle. The buckle can be operated easily by an adult, while remaining secure from disengagement by a typical child. The female part has an arcuate outer profile to improve the structural integrity of the overall buckle. Both the male and female parts can have thickened portions to permit the seatbelt assembly to be child resistant, while improving resistance to tensile, impact and compressive forces. A gap between the male and female buckle parts serves to enhance the child resistant characteristics of the buckle.

DETAILED DESCRIPTION OF THE PREFERRED EMBODIMENTS

Figure 1:
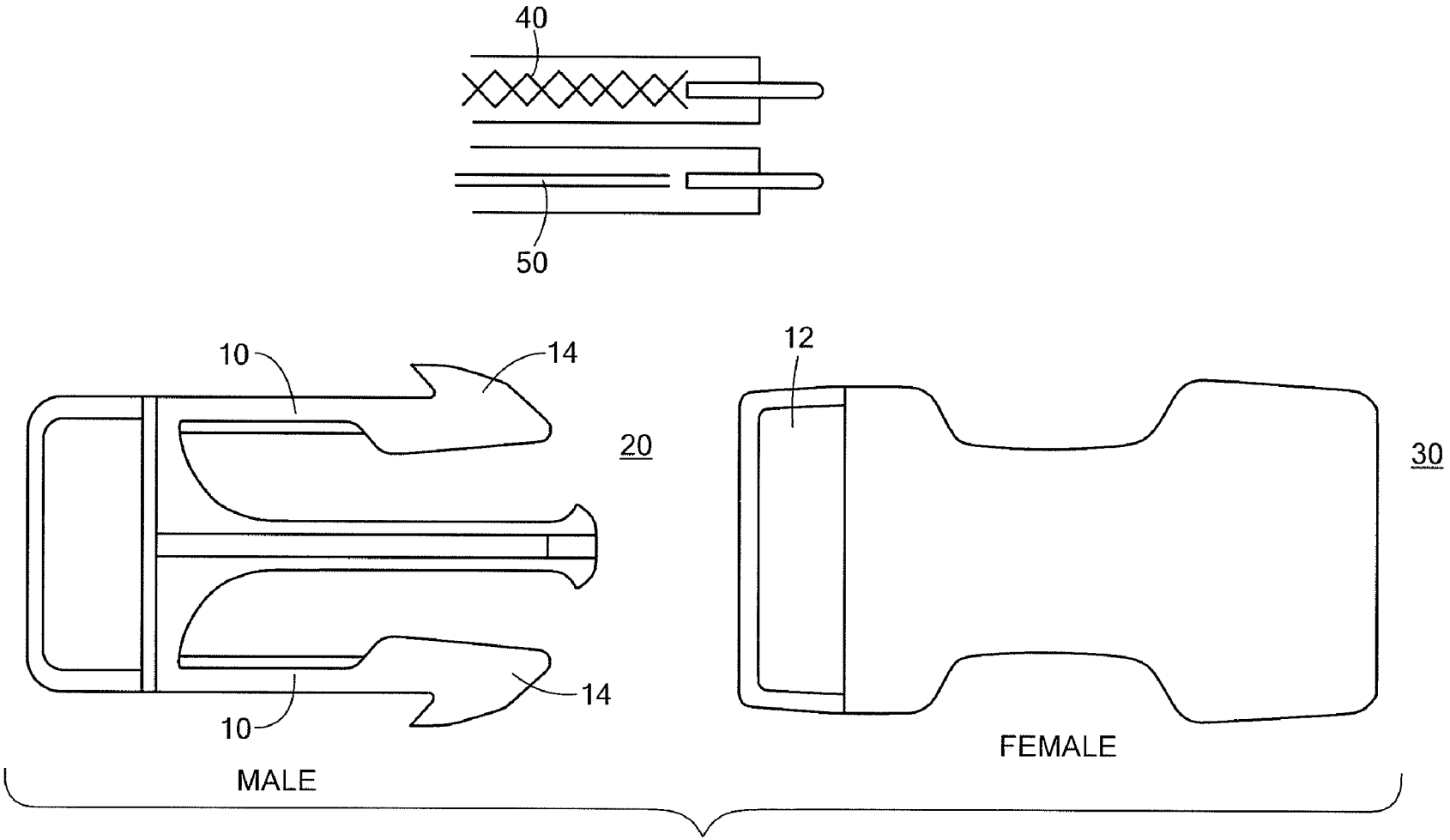
FIG. 1 is a plan view of a male and female mating connectors according to a first embodiment of the present invention.
Figure 2:
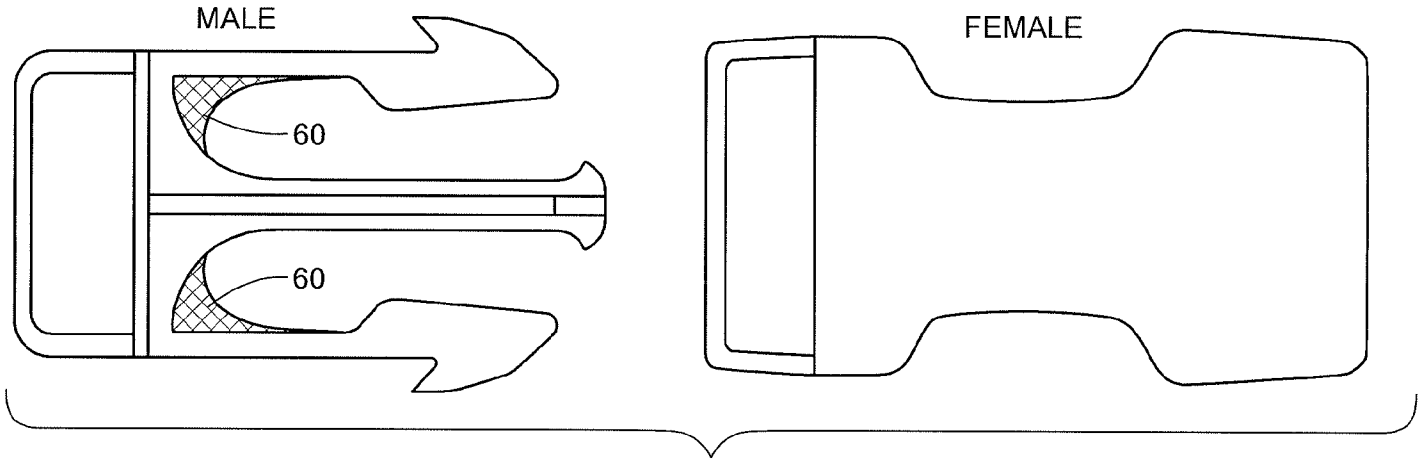
FIG. 2 is a plan view of the male and female connectors of a second embodiment according to the present invention.
Figure 3:
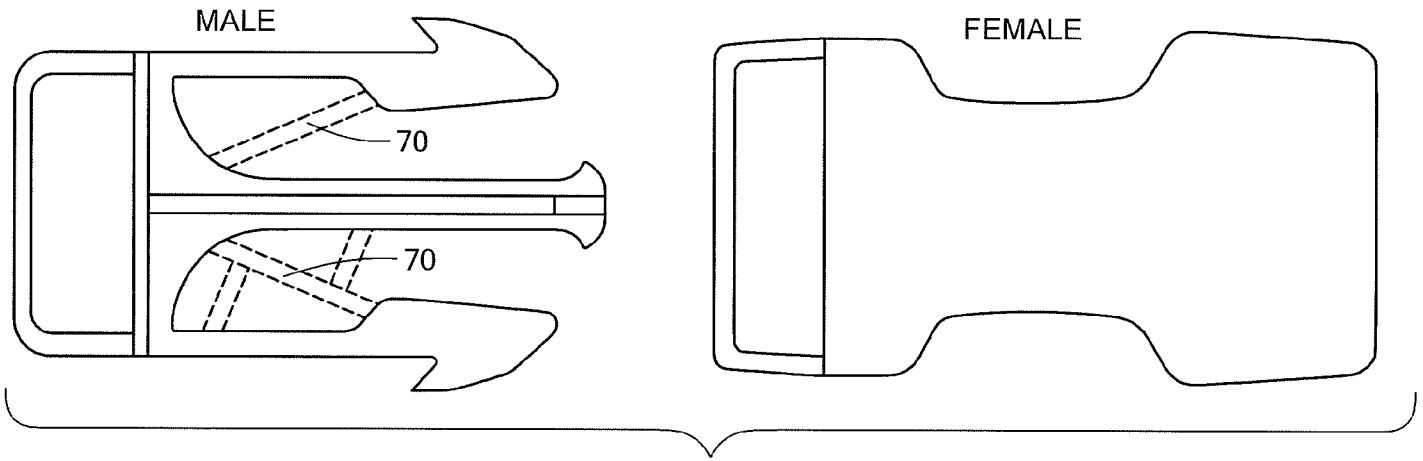
FIG. 3 is a plan view of a male and female buckle part according to a third embodiment of the present invention.
Figure 4:
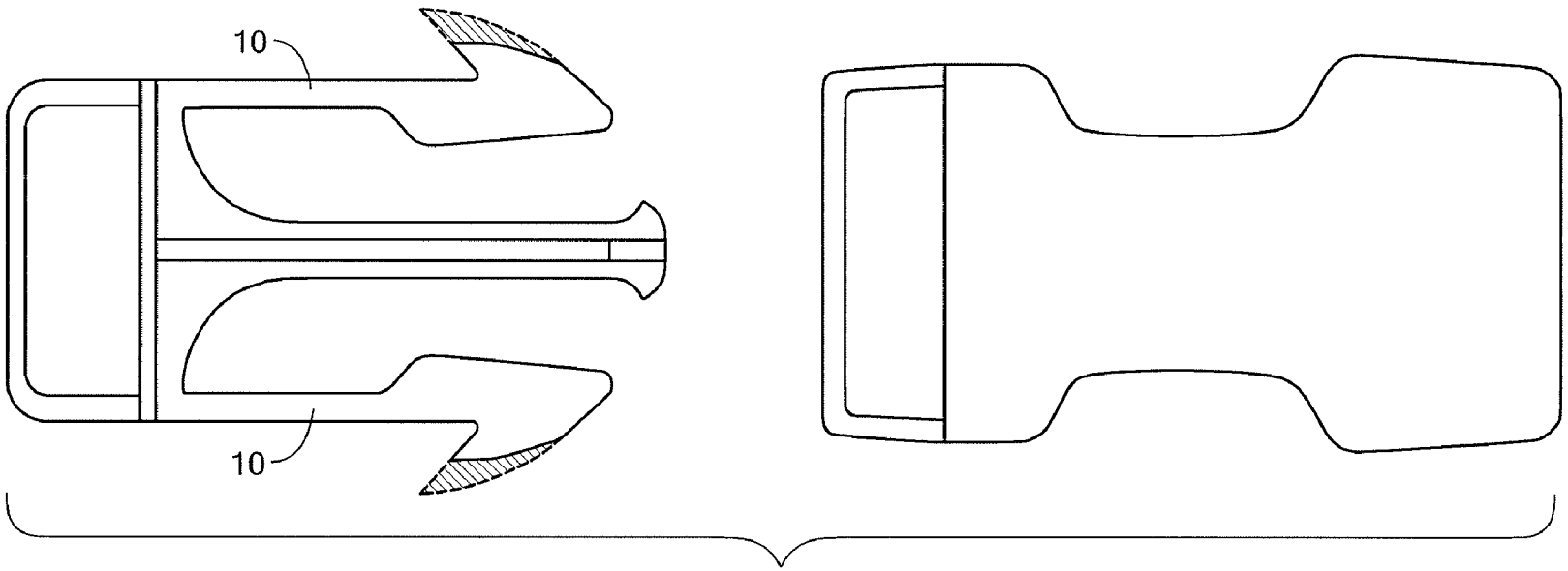
FIG. 4 is a plan view of a male and female buckle part according to a fourth embodiment of the present invention.

The present invention provides a simple child resistant buckle with design and operating features that are substantially the same as the prior art buckle made by ITW and others for use with seatbelt assemblies so that no new operating procedure need be learned. The buckle is resistant to tensile, impact and compressive forces, and is operated conventionally to undo the buckle and is thus more easily used by consumers. In contrast to the prior art ITW buckle, however, the amount of force required to undo the buckle is increased, thereby preventing young children from undoing the buckle. Referring to FIGS. 1-4, in which like elements are designated with like reference designations, in order to make the prior art buckle child resistant, according to one embodiment, the side latches 10 are reinforced with a strengthening structure to increase the force necessary to undo the buckle. For example, as shown in the drawings, a patterned rib 40 or straight rib 50 may be added, webbing 60 can be added in the form of a flange and struts 70, either single or multiple struts, which are collapsible upon the application of a threshold force, can be provided. According to another embodiment, as shown in the attached drawings (FIG. 4), the barbs or prongs are enlarged so that the side latches 10 are displaced a greater distance to be disengaged, thereby increasing the force for disengagement. According to another embodiment (FIG. 10), a child is prevented from operating the buckle easily by the provision of a gap between the prongs of a male connector and a side of a female connector.

Figure 5:
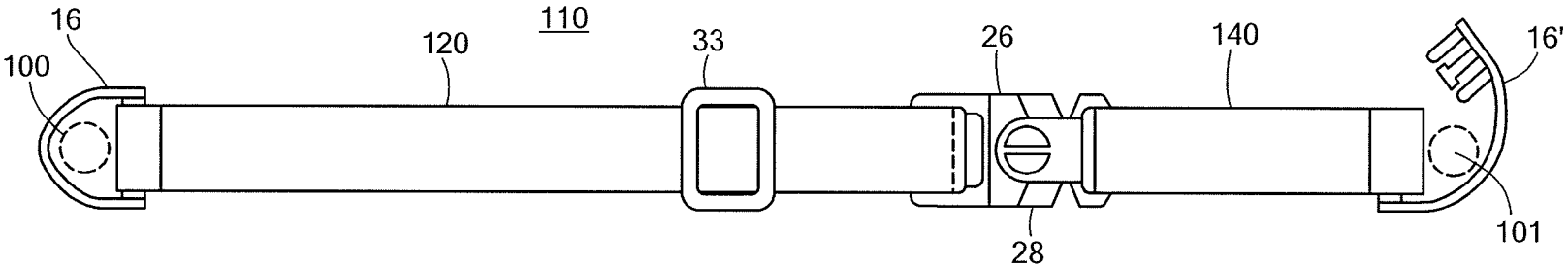
FIG. 5 is a plan view of a child seatbelt assembly according to the present invention.

Referring now to FIG. 5, a child restraint seatbelt assembly 110 is shown. Seatbelt assembly 110 includes a first strap portion 120 and a second strap portion 140. First and second strap portions 120 and 140 can be coupled to a device for carrying or restraining a child, such as a shopping cart for example. Bars 100 and 101 are illustrated in phantom in FIG. 5 to show parts of a typical shopping cart to which assembly 110 can be attached.

Strap retainers 16 and 16' permit strap portions 120, 140 to be fastened to a shopping cart without the use of tools. Any type of retainer mechanism including clasps, rings and loops can be used. The retainer mechanism should not be considered to be so limited, however, and need only function to attach strap portions 120, 140 to an object. For example, the retainers can be permanently attached to strap portions 120, 140, or can be removably attached. Also, the retainers can be produced separately from assembly 110, and provided with straps 120, 140 to be assembled on site, for example. Assembly 110 can be adjusted with a known belt adjuster 33. FIG. 5 shows female and male buckle connector pans 26 and 28, respectively. Buckle connector parts 26 and 28 are fastened to strap portions 140, 120, respectively in a known manner.

Figure 6:
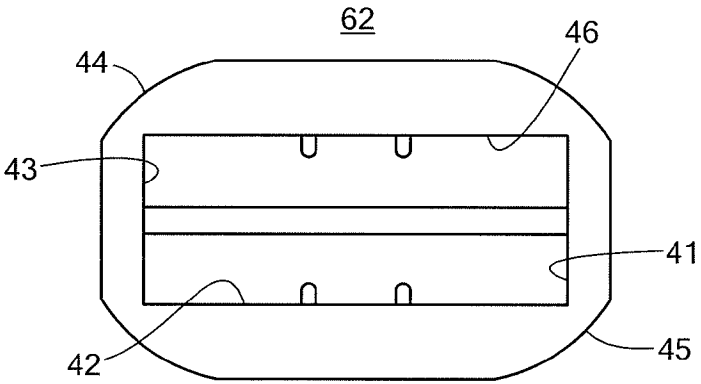
FIG. 6 is an end side view of an embodiment of a female connector according to the present invention.

Referring now to FIG. 6, a female buckle connector part 62 according to the present invention is shown. Connector part 62 has a partially oval shape described by arcuate section surfaces 44 and 45, with a rectangular inner surface shape defined by planar surfaces 41, 42, 43 and 46. Accordingly, a standard male connector, or male connector part 20 according to the present invention can fit into and engage with female connector part 62. Arcuate surfaces 44 and 45 provide a structural integrity enhancement to female connector part 62 because a cross-section of material between surfaces 44 and 46, for example, is dome-shaped. In addition, the increased material between surfaces 44 and 46, for example, as compared to prior art connectors, enhances the ability of connector part 62 to withstand external forces, including increased tensile, impact and compression forces. For example, it is estimated that the advantages of the design of connector part 62 described above results in a threefold increase in resistance to impact forces.

While conventional buckles have a wall thickness of less than about 0.07 inches, the buckle according to the present invention preferably has a wall thickness range of from about 0.07 inches to about 0.14 inches. The additional wall thickness provides significant increases in resistance to stress and external forces. Accordingly, the design of connector part 62 also resists deformation that can occur with applied compressive forces. Because of the greater resistance to external forces exhibited by connector part 62, a more substantial male connector part can be used. Use of more substantial male connector can increase overall resistance of the buckle to external tensile, impact and compression forces. A more substantial male connector can also further assist the child-safety feature of the present invention and provide a more robust and longer lasting seatbelt assembly.

Figure 7:
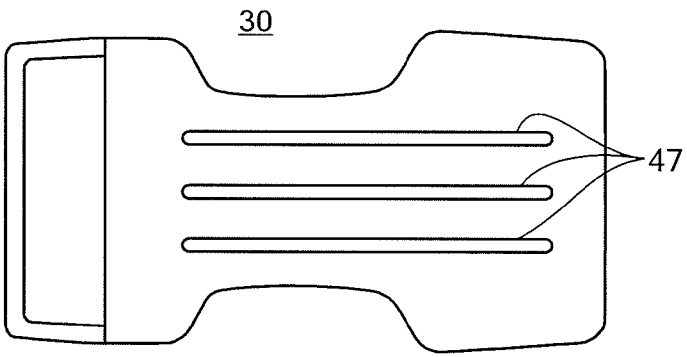
FIG. 7 is a plan view of another embodiment of a female connector according to the present invention.

It should be clear that the embodiment shown in FIG. 6 is not limiting for the present invention, in that a number of strengthening structures can be used. For example, FIG. 7 illustrates arcuate section surface 44 replaced with several ribs 47 extending in a lengthwise direction. It should be apparent that ribs 47 can be extended in any direction. A series of arcuate surfaces covering separate portions of connector part 62 can be used as well. A reinforcing structure can also take the form of a web, or criss-crossed ribs. Additionally, each of these reinforcing or strengthening structures can be used in combination with each other, or with other similar structures for reinforcement or strengthening.

Figure 8:
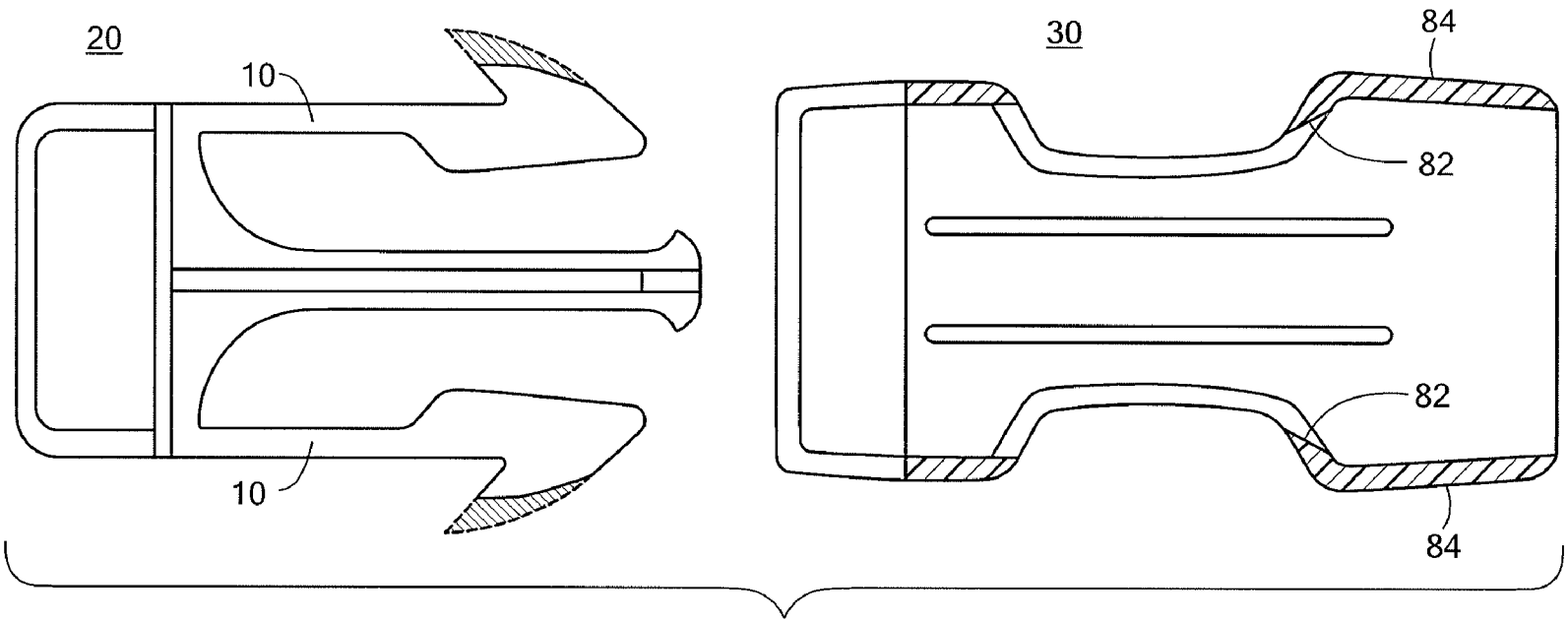
FIG. 8 is a cutaway plan view of another embodiment of a female connector according to the present invention.
Figure 9A:
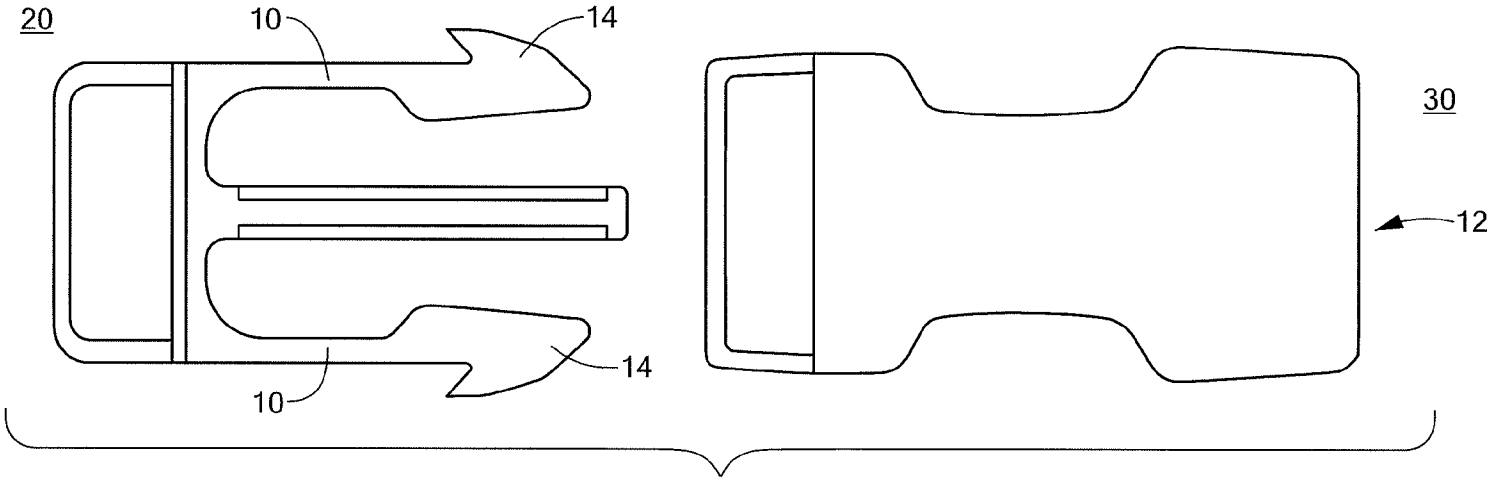
FIG. 9a PRIOR ART
FIG. 9*a* is a plan view of a conventional male and female mating connector.
Figure 9B:
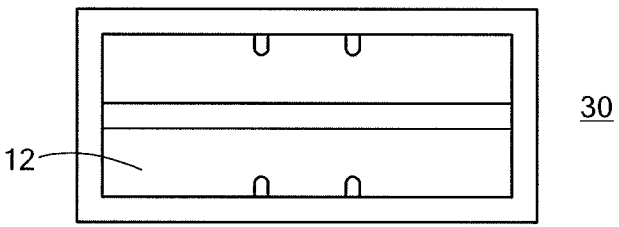
FIG. 9b PRIOR ART
FIG. 9*b* is an end side view of a conventional female connector.

While FIGS. 1-4 show child safety improvements to male connector 20, female connector 30 can also include child resistant features. Referring to FIG. 8, for example, a shoulder portion 82 of lateral sides 84 of female connector 30 provides an extended engagement surface. By providing extensions to the shoulder portion 82, the prongs on male connector 20 do not disengage from female connector 30 until side latches 10 are compressed together a further distance. The inward extension of the shoulder portions can also contribute to preloading side latches 10 to further enhance the child-resistant feature. That is, not only are the tangs displaced a greater distance to open the buckle because of the extended shoulder portions, but the force to displace the tangs over the displaced distance is likewise increased because of the preloading action.

Each of the above described features for increasing the compressive force resistance of the prongs on male connector 20 all have the same goal of providing a child resistant buckle. Each of the above described features accomplish this goal in different ways, however, the overall affect is to increase the pressing force applied to the prongs of male connector 20 to disengage the buckle. One of the factors that becomes important in adopting a buckle design to increase an applied force sufficient to disengage the buckle is repeatability under stress. That is, the design should be able to provide a threshold pressing force on a consistent basis, even when subjected to compressive and impact forces that are somewhat typical of buckles in an ordinary shopping cart environment, for example.

Accordingly, the improvements to the connector 30 serve to preserve the tolerances of the buckle associated with aspects of the child-resistant feature. That is, by making female connector 30 more robust and resistant to impact and compressive forces, the buckle is less likely to experience tolerance changes that may affect the child resistant feature.

A pressing force threshold level for disengaging the buckle is believed to be an effective child resistant measure that can be verified through empirical data and field studies. Provided that the threshold level is set high enough, children in a certain age range should typically be unable to open the buckle, while adults or responsible minors can easily open the same buckle.

The child resistant buckle must also be easily opened by adult individuals with typically less pressing strength. For example, an individual of age 60 or greater typically has less of an ability to apply a pressing force to disengage the buckle, than does an individual of age 30 when all other factors are balanced and taken into account. Accordingly, a child resistant buckle based on a threshold level for a pressing force must be high enough to be inoperable for a child of a given age, but still easily operable for individuals of a given age range.

In a survey conducted by Mathiowetz et al. in 1985, 310 males ages 20-94 and 318 females ages 20-94 were tested to determine pinch force ability between a thumb and index finger. The results were aggregated to obtain an average pinch force for both the male and female sample populations. The results of the survey indicated that the males exert an average pinch or pressing force of 16.93 pounds with a standard deviation of 0.918, while females exert an average pinch or pressing force of 11.36 pounds with a standard deviation of 0.582. A child resistant buckle is thus preferably openable with 10.78 pounds of force or less, provided the force is great enough to be child resistant.

In conducting an extensive and exhaustive study of the amount of pressing force able to be exerted by a child aged 4½ and younger, it was found that a certain pressing force threshold will prevent nearly all instances of undesirable operation of the buckle by a child in the above-mentioned age range. A study was conducted by Owings in 1977 to determine average maximum pinching strength of children in the age range of 3½ to 4½. The study concluded that the average maximum pinching strength for the children tested was about 5.7 pounds over a distance of about 2 cm. Over a distance of about 5 cm, the resulting strength applicable was 6.39 pounds. Accordingly, a threshold level for a 3 cm wide buckle with increased resistance to pressing force for children aged 4½ and younger should be approximately 5.93 pounds of force. Below this level, children aged 4½ and younger are increasingly able to operate the buckle as the force diminishes. Above this level, children aged 4½ and younger are typically unable to operate the buckle. With regard to adult operation, the preferable maximum amount of force to open a buckle is less than about 10.78 pounds average minimum–standard deviation), as described above. Accordingly, it would be desirable to provide a buckle with an opening force that is greater than approximately 5.93 pounds, but less than approximately 10.78 pounds.

An extensive study of available buckles has been conducted to determine whether any known buckle meets this criteria. At the end of this exhaustive study, it was determined that only one buckle met the desired criteria of child resistance with a simple and intuitive construction and operation, the buckle constructed according to the present invention. The results of the study and evaluation of pressing force to open compression fit type buckles is tabulated below in Table I.

TABLE I

| BUCKLE ID | SAMPLE NO. | OPENING FORCE | AVERAGE FORCE |
|---|---|---|---|
| UN | 1 | 3.6 | |
| | 2 | 4.0 | |
| | 3 | 3.9 | |
| | 4 | 4.0 | |
| | 5 | 3.4 | 3.8 |
| NL | 1 | 2.3 | |
| | 2 | 2.1 | |
| | 3 | 2.0 | |
| | 4 | 1.9 | |
| | 5 | 1.9 | 2.0 |
| SS1 | 1 | 3.1 | |
| | 2 | 2.8 | |
| | 3 | 3.2 | |
| | 4 | 2.8 | |
| | 5 | 2.8 | 2.9 |
| RG | 1 | 3.1 | |
| | 2 | 3.4 | |
| | 3 | 2.9 | |
| | 4 | 2.8 | |
| | 5 | 2.5 | 2.3 |
| DL | 1 | 3.3 | |
| | 2 | 4.4 | |
| | 3 | 3.9 | |
| | 4 | 2.6 | |
| | 5 | 3.8 | 3.6 |
| SS2 | 1 | 6.6 | |
| | 2 | 6.6 | |
| | 3 | 6.7 | |
| | 4 | 7.2 | 6.8 |
| WR | 1 | 4.3 | |
| | 2 | 4.1 | |
| | 3 | 4.3 | |
| | 4 | 4.1 | 4.2 |
| AL | 1 | 4.9 | |
| | 2 | 4.7 | |
| | 3 | 5.2 | |
| | 4 | 4.9 | 4.9 |
| SA1 | 1 | 1.6 | |
| | 2 | 1.6 | |
| | 3 | 1.6 | |
| | 4 | 1.7 | 1.6 |
| SN1 | 1 | 0.9 | |
| | 2 | 1.0 | |
| | 3 | 1.0 | |
| | 4 | 1.1 | 1.0 |
| RL1 | 1 | 3.7 | |
| | 2 | 3.3 | |
| | 3 | 4.0 | |
| | 4 | 3.6 | 3.7 |
| RL2 | 1 | 2.9 | |
| | 2 | 2.8 | |
| | 3 | 3.2 | |
| | 4 | 3.0 | 3.0 |
| SA2 | 1 | 2.0 | |
| | 2 | 2.3 | |
| | 3 | 1.9 | |
| | 4 | 2.1 | 2.1 |
| WL1 | 1 | 3.5 | |
| | 2 | 3.3 | |
| | 3 | 3.4 | |
| | 4 | 3.1 | 3.3 |
| MA1 | 1 | 3.2 | |
| | 2 | 3.2 | |
| | 3 | 3.2 | |
| | 4 | 3.5 | 3.3 |
| SA3 | 1 | 1.6 | |
| | 2 | 1.4 | |
| | 3 | 1.7 | |
| | 4 | 1.7 | 1.6 |
| MA2 | 1 | 3.1 | |
| | 2 | 3.2 | |
| | 3 | 3.2 | |
| | 4 | 2.9 | 3.1 |

TABLE I-continued

| BUCKLE ID | SAMPLE NO. | OPENING FORCE | AVERAGE FORCE |
|---|---|---|---|
| SL | 1 | 2.2 | |
| | 2 | 2.3 | |
| | 3 | 2.4 | |
| | 4 | 2.2 | 2.3 |
| AC | 1 | 4.9 | |
| | 2 | 4.6 | |
| | 3 | 4.8 | 4.8 |
| TC | LEFT SIDE | 5.2 | |
| | RIGHT SIDE | 5.3 | 5.3 |
| WL2 | 1 | 3.5 | |
| | 2 | 3.3 | 3.4 |
| RL3 | 1 | 2.8 | |
| | 2 | 3.1 | |
| | 3 | 2.8 | 2.9 |
| SA3 | 1 | 4.4 | |
| | 2 | 4.6 | |
| | 3 | 4.5 | |
| | 4 | 4.6 | 4.5 |
| SN2 | 1 | 0.9 | |
| | 2 | 1.2 | |
| | 3 | 1.0 | |
| | 4 | 1.1 | 1.1 |
| MA3 | 1 | 3.1 | |
| | 2 | 3.3 | |
| | 3 | 3.0 | |
| | 4 | 3.2 | 3.1 |
| MA4 | 1 | 2.1 | |
| | 2 | 2.1 | |
| | 3 | 2.0 | |
| | 4 | 2.0 | 2.1 |
| MA5 | 1 | 0.8 | |
| | 2 | 0.8 | |
| | 3 | 0.8 | |
| | 4 | 0.8 | 0.8 |
| RL4 | 1 | 2.9 | |
| | 2 | 2.8 | |
| | 3 | 2.7 | |
| | 4 | 2.8 | 2.8 |
| NL2 | 1 | 2.3 | |
| | 2 | 2.4 | |
| | 3 | 2.2 | |
| | 4 | 2.3 | |
| | 5 | 2.3 | 2.3 |
| AW1 | 1 | 0.8 | |
| | 2 | 0.7 | |
| | 3 | 0.6 | |
| | 4 | 0.6 | |
| | 5 | 0.6 | 0.7 |
| YK1 | 1 | 1.5 | |
| | 2 | 1.1 | 1.3 |
| NL3 | 1 | 2.3 | 2.3 |
| UI1 | 1 | 3.4 | |
| | 2 | 3.0 | 3.2 |
| NL4 | 1 | 1.3 | |
| | 2 | 1.0 | |
| | 3 | 0.9 | |
| | 4 | 1.8 | 1.3 |
| WL3 | 1 | 1.5 | |
| | 2 | 2.2 | |
| | 3 | 1.6 | 1.8 |
| IT1 | BLACK | 1.9 | 1.9 |
| | GRAY | 3.8 | 3.8 |
| VC | BLACK 1 | 2.1 | |
| | BLACK 2 | 1.9 | 2.0 |
| | GRAY | 3.7 | |
| | RED | 3.6 | 3.7 |
| IT2 | 1 | 2.4 | |
| | 2 | 1.8 | |
| | 3 | 1.6 | |
| | 4 | 1.5 | 1.8 |
| IT3 | 1 | 4.6 | |
| | 2 | 4.5 | 4.5 |
| IT4 | 1 | 3.4 | |
| | 2 | 3.0 | 3.2 |
| IT5 | 1 | 2.2 | 2.2 |
| UI2 | 1 | 1.6 | 1.6 |

TABLE I-continued

| BUCKLE ID | SAMPLE NO. | OPENING FORCE | AVERAGE FORCE |
|---|---|---|---|
| UI3 | 1 | 3.7 | 3.7 |
| UI4 | 1 | 1.9 | 1.9 |
| IT6 | 1 | 4.2 | |
| | 2 | 3.6 | |
| | 3 | 4.2 | |
| | 4 | 3.5 | 3.9 |
| LK | 1 | 2.7 | |
| | 2 | 2.5 | |
| | 3 | 2.3 | |
| | 4 | 2.2 | 2.4 |
| YK2 | 1 | 2.8 | 2.8 |
| AW2 | 1 | 0.8 | |
| | 2 | 0.9 | |
| | 3 | 0.8 | |
| | 4 | 0.7 | 0.8 |

The data in Table I is for the minimum force applied that will open the tested buckle. This number is used to gauge child resistant characteristics of the tested buckle with the view that a child would be able to apply the least amount of pressure needed to open the buckle. As can be seen from the data provided in Table I above, there is a wide range of pressing force applied to the prongs of a male member that can disengage a buckle. However, the pressing forces fall below the threshold value of approximately 5.5 pounds of force with little variation, with the exception of buckle ID SS2, a buckle made according to the present invention. Variations in the opening force among various samples of the different buckles is typically attributable to variations in manufacturing processes that produce variations in the tolerance of the buckle components. Nevertheless, the buckle according to the present invention with buckle ID SS2 consistently tests above 5.5 pounds of force for opening operation.

Accordingly, by providing a buckle that has a consistent opening force equal to or greater than approximately 5.5 pounds, the present invention is able to achieve child resistant results unmatched by any other buckle. When the buckle according to the present invention is constructed to consistently have greater than 6.0 pounds of pressing force to permit opening, the buckle should exceed the ratings at which children under the age of 4½ are able to open the buckle. As can be seen by the sample date, the force for buckle ID SS2 meets this criteria. Thus, the buckle according to the present invention is consistently child resistant, where other buckles are unable to provide such a feature.

In studies to validate the child resistance of the buckle according to the present invention, in which a pressing force of approximately 5.5 pounds or greater would disengage the buckle, only about 4% of children under the age of 4½ years were able to successfully operate the buckle. As an example, the buckles were found to be 96% child resistant to children ages 48 months and younger in a group of 50 children. The buckle design according to the present invention is, however, easily openable by adults who are typically easily able to exert a force of about 10 pounds to disengage the buckle. The applied force is developed as a pinching force against the two prongs so that both prongs are disengaged from the female member.

Another child resistant feature for the compression fit type buckles discussed herein is obtained by varying a width of the buckle in conjunction with pressing force. That is, it is more difficult for a child to pinch the prongs of a narrow buckle with enough leverage to exert pressure sufficient to open the buckle than it is for a wide buckle. Accordingly, as the width of the buckle decreases, the force threshold to make the buckle child resistant also decreases, making the buckle easier to operate for adults, while still being child resistant. Conversely, as the buckle width increases, the force threshold for child resistance increases. Several prior art buckles have typically greater widths than the buckle according to the present invention, however, pressing force des not increase with width in these prior art buckles. Accordingly, not only are the wider prior art buckles more susceptible to being opened by a child, they do not meet the threshold for child resistance according to the present invention. As an example, one buckle measures 4.0 cm, and has an average minimum opening force of 5.6 pounds. The greater width and opening force combine to decrease the child resistance available in the buckle design.

Figure 10:
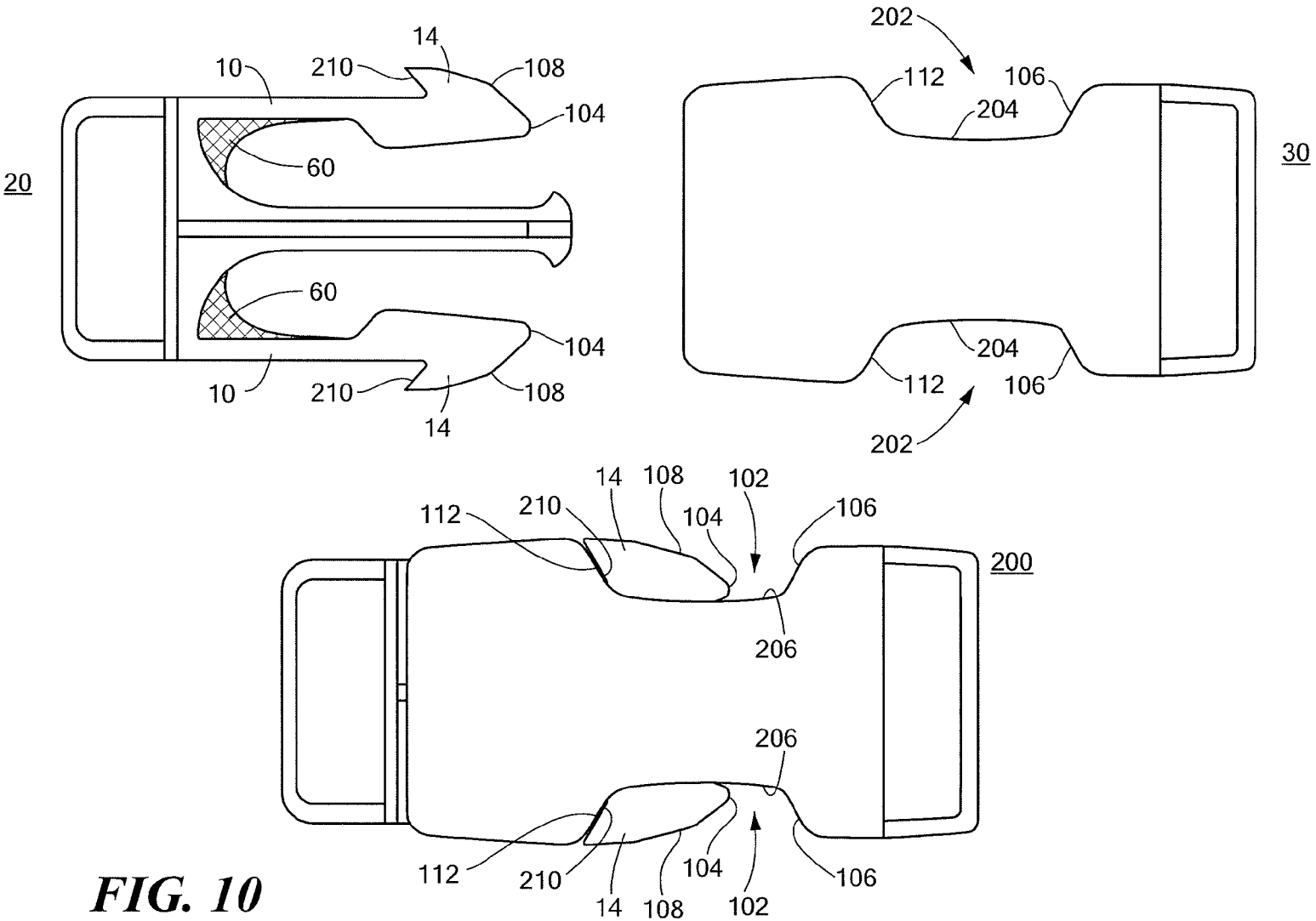
FIG. 10 is a plan view of a buckle according to another embodiment of the present invention.

Referring now to FIG. 10, another child resistant feature according to the present invention is illustrated in a clasped buckle 200. Clasped buckle 200 is, for example, the union of male connector 20 and female connector 30 in an engaged arrangement. Female connector 30 has slot openings 202 composed of walls 106, shoulders 112 and floors 204. With male connector 20 and female connector 30 engaged as shown to obtain clasped buckle 200, a gap 102 is provided on either side of female connector 30, formed with a gap floor 206 that is part of floor 204 in between a pointed end portion 104 of barbs 14, and a slot wall 106 on female connector 30. By providing gaps 102 composed of gap floors 206 between pointed portion 104 and walls 106, a child attempting to release the buckle has their fingers urged into gaps 102, where gap floors 206 block further progress of the child's fingers, preventing the child from opening the buckle. Barbs 14 have a sloped surface 108 that tapers inward toward floor 204 from a catch 210 to pointed portion 104 when buckle 200 is clasped to contribute to implementing the child resistant feature. A child seeking to unclasp the buckle may attempt to pinch barbs 14 together to release male connector 20 from female connector 30. In doing so, the child's fingers ride along slopes 108 and are urged by the slopes into gaps 102, effectively preventing the child from exerting a force on barbs 14 that would be sufficient to open the buckle.

In conventional buckles, gaps 102 do not exist, or are insufficiently large enough to accommodate a child's finger. Accordingly, a child pinching a set of conventional barbs is able to exert greater pressure on the barbs, even if the child's fingers slide towards ends of the barbs, because the child's fingers do not come to rest at a disabling portion of the clasped buckle. Rather, in the conventional buckle, the child will find support for their fingers in the sloped side wall of the female member that is close enough to the barbs to permit the child to exert leverage on both the sloped side wall and the prongs to achieve an opening force sufficient to unclasp the buckle.

The embodiment shown in FIG. 10 is additionally advantageous when webbing 60 is provided on male connector 20, for example. Webbing 60 tends to increase the stiffness of side latches 10, so that barbs 14 move in an arcuate path when pinching pressure is applied. That is, side latches 10 tend to flex near a base of barb 14, rather than near a base of side latch 10. Accordingly, barb 14 moves in an arcuate path that further promotes child resistance in the clasped buckle illustrated in FIG. 10.

When a child attempts to pinch barbs 14 together to unclasp the buckle, and the child's fingers slide into gaps 102, the child still may be able to exert a force near pointed portions 104 in an attempt to displace barbs 14 to unclasp the buckle. However, because barbs 14 move in an arcuate path, even if the child is successful in displacing barbs 14 towards each other with a pinching force, because the force is applied in proximity to gap floors 206 of gaps 102, the arcuate path of barbs 14 causes pointed portions 104 to move closer to each other at a greater displacement than catches 210 on barbs 14. Accordingly, even thought the child can compress pointed portions 104 together, catches 210 remain securely positioned on shoulders 112 of female connector 30. In contrast, an adult is easily able to compress barbs 14 together by applying pressure at a location away from pointed portions 104 to sufficiently displace barbs 14 so that catches 210 are disengaged from shoulders 112, and the buckle is released. Even if an adult's fingers slides down slopes 108, and into gap 102, the pressing force exerted by the adult is capable of displacing barbs 14 sufficiently to open the buckle. In addition, an adult's fingers are typically larger in diameter than a child's fingers, permitting the adult to provide a greater displacement on barbs 14, even when the adult's fingers are in gaps 102.

Figure 11:
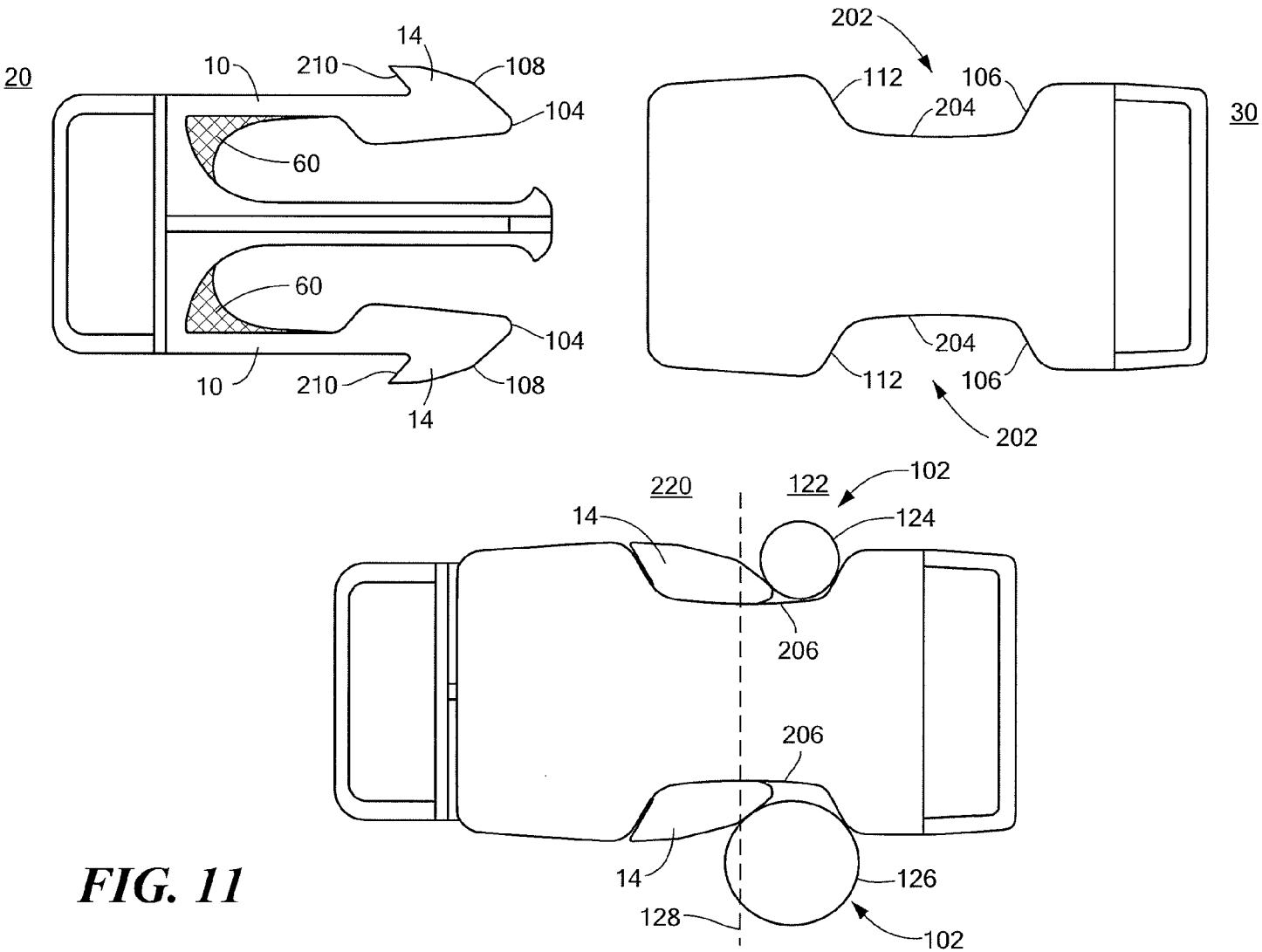
FIG. 11 is a plan view of the buckle of FIG. 10 showing functional regions of operation.

Referring now to FIG. 11, a child's finger 124 and an adult's finger 126 is illustrated positioned in gaps 102. As can be seen from the drawing, child finger 124 is easily accommodated in gap 102, being able to contact gap floor 206 while adult finger 126 is too large to completely fit in gap 102, and does not necessarily contact gap floor 206. Accordingly, even if child finger 124 can exert a large force, the buckle will not unlatch due to the position of finger 124. Adult finger 126, on the other hand, is able to deflect barbs 14 to open the buckle.

With respect to finger size, even though both child and adult fingers 124, 126 substantially slide into gaps 102, child finger 124 is totally within a nonfunctional zone 122, as indicated with dashed divider line 128. Adult finger 126, however, overlaps barb 14 to lie within a functional zone 220. Because adult finger 126 is able to move barb 14 in functional zone 220 because of an appropriate sizing, an adult can open the buckle, where a child cannot. In addition, child finger 124 is prone to landing in gap 102, which is completely in nonfunctional zone 122, through the action of slopes 108. A child is thus unable to get a good grip on barb 14 due to lack of a stable landing or footing for child finger 124 on barb 14. Furthermore, slot walls 106 tend to help an adult secure a footing in pressing barbs 14, since adult finger 126 is large enough to abut slot wall 106 while remaining at least partially in functional zone 220.

It should be apparent that non-functional zone 122 can be tailored to a given application. For example, gaps 102 can be eliminated but non-functional zone 122 can remain the same. That is, a child may depress barb 14 in non-functional zone 122 when there is no gap 102 provided, however, that barb 14 will not displace sufficiently for the buckle to open.

Gap 102 can be created a number of ways, for example by extending female connector 30, or shortening male connector 20. Slot openings 202 on either side of female connector 30 can be made deeper or shallower, or have a contour to assist in disabling the buckle for child fingers. For example, slot openings 202 can be shallower in nonfunctional zone 122, while deeper in functional zone 220 to further enhance the child resistant functions and features.

The invention thus provides a simpler, more intuitive way of providing a child resistant buckle for a seatbelt assembly that utilizes the same releasing actions as in the prior art buckle so that consumers will be accustomed to its use the first time it is used. The buckle only requires that a greater force be applied to undo it and release the seatbelt assembly. The force required should be enough so that the buckle is incapable of being undone by a typical child but can be operated by the children's parents or guardians or other adult supervisors.

The female connector of the present invention can absorb greater external forces, and results in a more robust design overall. With a stronger female connector according to the present invention, a stronger male connector can also be used, effectively improving child-resistancy of the seatbelt assembly without adding further complexity. The arcuate shape of the female connector part surfaces achieves greater strength while avoiding a large increase in the amount of material needed.

Although ribs, struts, webs, flanges and enlarged barbs are shown for the male connector, other embodiments can be developed which are in accordance with the concepts disclosed herein. Although arcuate surfaces are shown for the female connector, other embodiments including those described hereinabove, can be developed and applied that are in accordance with the concepts disclosed herein. Further, combinations of the above embodiments can be provided. Further, the enlarged prongs or barbs of FIG. 4 can be provided along with strengthened latch parts as in FIGS. 1 to 3. Further, an impact modified nylon composition known generically as impact modified PA66 or high impact PA66 or toughened PA66, and commercially as ST801, in formulations of 50% or greater, is preferably used as the buckle material, although other polymers or other formulations can be used. A non-exhaustive list of preferred material for constructing the buckle includes nylon, toughened nylon or toughen PA66, high impact nylon or high impact PA66, impact modified nylon or impact modified PA66. In addition, one or more surfaces of the female connector can have arcuate surfaces to increase the strength of the connector and reduce the risk of tolerance losses due to impact or compressive forces.

When the buckle is composed of ST801 in formulations of 50% or greater, the buckle tends to be easier to operate, i.e., less pressing force is needed to open the buckle. Accordingly, the buckle design is modified to increase pressure force to open the buckle when ST801 in formations of 50% or greater is used as the buckle material.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A child resistant seat belt buckle, comprising:

a first buckle connector having a pair of latch arms;

a second buckle connector having a pair of latch receptacles for receiving respective ones of the latch arms to couple the first and second buckle connectors together;

the first and second buckle connectors being uncoupled through displacement of both of the latch arms away from respective latch receptacles to disengage the latch arms and latch receptacles; and the latch arms both being arranged to be displaceable with a displacement urging force applied to both latch arms in concert; and the latch arms having a construction to resist displacement until subjected to a concerted displacement urging force of about 5.5 pounds or greater.

2. The buckle according to claim 1, wherein the concerted displacement force is equal to or greater than about 6.0 pounds.

3. The buckle according to claim 1, wherein the concerted displacement force is equal to or greater than about 6.5 pounds.

4. The buckle according to claim 1, wherein the concerted displacement force is in the range of from about 6.0 pounds to about 16 pounds.

5. The buckle according to claim 1, wherein the concerted displacement force is in the range of from about 5.5 pounds to about 17.5 pounds.

6. The buckle according to claim 1, wherein the concerted displacement force is in the range of from about 6.0 pounds to about 10.75 pounds.

7. The buckle according to claim 1, wherein the first and second buckle connectors are composed of an impact modified nylon.

8. The buckle according to claim 1, wherein the buckle has a width dimension greater than or equal to approximately 3 cm.

9. The buckle according to claim 1, wherein the latch arms are arranged in a coupled buckle such that the force is applied as a squeezing force over a dimension of about 3 cm.

10. The buckle according to claim 9, wherein the first and second buckle connectors are composed of an impact modified nylon.

11. The buckle according to claim 9, wherein the buckle connectors have walls with a thickness of greater than about 0.07 inches.

12. The buckle according to claim 1, wherein one or more of the latch arms further comprise:

a tapered portion accessible to the displacement urging force when the first and second buckle connectors are coupled together;

an engagement structure and an operative region on the tapered portion near the engagement structure;

a non-operative region on the tapered portion and farther away from the engagement structure than the operative region; and the tapered portion being shaped to urge the displacement urging force toward the non-operative region.

13. The buckle according to claim 1, wherein the buckle connectors have walls with a thickness of greater than about 0.07 inches.

14. The buckle according to claim 13, wherein the first and second buckle connectors are composed of an impact modified nylon.

15. The buckle according to claim 1, further comprising:

a range of movement of one or more of the latch arms;

a portion of the range being operative to permit the one or more latch arms to be disengaged from a respective latch receptacle; and a tapered portion on the one or more latch arms being shaped or positioned to impede the displacement urging force from operating the one or more latch arms in the operative range portion.

16. The buckle according to claim 1, wherein one or more of the latch receptacles further comprises:

an edge arranged to cooperate with a respective latch arm to engage the latch arm and the one or more latch receptacle; and a relationship between the latch arm and the one or more latch receptacle wherein the latch arm is urged against the edge of the one or more latch receptacle in an engaged position to thereby preload the latch arm against the displacement urging force.

17. A child resistant seatbelt buckle, comprising:

a buckle connector having a first pair of latch members;

another buckle connector having a second pair of latch members operable to cooperatively engage with respective ones of the first pair to couple the buckle connectors together when the first and second pairs of latch members cooperate;

one of the first or second pairs of latch members being displaceable;

the buckle connectors being uncoupled through displacement of the displaceable pair of latch members away from respective ones of the other of the first or second pair;

each of the latch members of the displaceable pair being arranged to be displaceable with a combined displacement urging force applied simultaneously to both displaceable latch members; and a construction of the displaceable latch members enabling resistance to displacement until subjected to the combined displacement urging force of about 5.5 pounds or greater.

18. The buckle according to claim 17, wherein the combined displacement force is equal to or greater than about 6.0 pounds.

19. The buckle according to claim 17, wherein the combined displacement force is equal to or greater than about 6.5 pounds.

20. The buckle according to claim 17, wherein the combined displacement force is in the range of from about 6.0 pounds to about 16 pounds.

21. The buckle according to claim 20, wherein the first and second buckle connectors are composed of an impact modified nylon.

22. The buckle according to claim 20, wherein the buckle connectors have walls with a thickness of greater than about 0.07 inches.

23. The buckle according to claim 17, wherein the combined displacement force is in the range of from about 5.5 pounds to about 17.5 pounds.

24. The buckle according to claim 17, wherein the combined displacement force is in the range of from about 6.0 pounds to about 10.75 pounds.

25. The seatbelt assembly according to claim 17, wherein the buckle connectors are composed of an impact modified nylon.

26. The buckle according to claim 17, wherein the buckle has a width dimension greater than or equal to approximately 3 cm.

27. The buckle according to claim 17, wherein the displaceable latch members are arranged in a coupled buckle such that the force is applied as a squeezing force over a dimension of about 3 cm.

28. The buckle according to claim 17, wherein the displaceable latch members further comprise:

an engagement structure for engaging the respective cooperative latch member in the other of the first or second pair; and a tapered portion near the engagement structure having operative and non-operative regions;

the non-operative region being located farther away from the engagement structure than the operative region; and the tapered portion being shaped to urge the displacement urging force toward the non-operative region.

29. The buckle according to claim 17, wherein the buckle connectors have walls with a thickness of greater than about 0.07 inches.

30. The buckle according to claim 17, further comprising:

a range of movement for each of the displaceable latch members;

a portion of each range being operative to permit the buckle connectors to be uncoupled; and a tapered portion on each of the displaceable latch members being shaped or positioned to impede the displacement urging force from operating displaceable latch members in a respective operative range portion.

31. The buckle according to claim 17, wherein the construction of one or more of the latch members in the first or second pair further comprises:

an edge arranged to cooperate with the respective cooperative latch member in the other of the first or second pair to contribute to permitting the first and second latch members to be cooperatively engaged; and the respective cooperative latch member being urged against the edge in an engaged position to thereby preload the respective cooperative latch member against the displacement urging force.

32. A child resistant buckle, comprising:

a female connector having an opening on one end and an elongated notch in an outer surface;

the elongated notch having a floor and a wall adjoining the floor for defining a portion of the notch;

a through slot in the floor of the elongated notch to permit the notch to receive a latch component from inside the female connector;

a male connector receivable in the opening of the female connector and including at least one resilient tang with a fixed end and a moveable end and a tapered portion extending away from the moveable end and being releasably receivable for engagement in the slot when the female and male connectors are coupled such that the moveable end, floor and wall form another notch smaller than the elongated notch; and the smaller notch forming a non-operative area, whereby the at least one tang is not substantially disengaged when actuated at the smaller notch.

33. The buckle according to claim 32, wherein the tapered portion contributes to urging an applied actuation toward the non-operative area to contribute to preventing uncoupling of the male and female connectors by a child.

34. The buckle according to claim 32, wherein the at least one tang further comprises:

an engagement structure and an operative region on the tapered portion near the engagement structure;

a non-operative region on the tapered portion and farther away from the engagement structure than the operative region; and the tapered portion being shaped to urge an applied actuation toward the non-operative region.

35. The buckle according to claim 32, further comprising:

a range of movement of the at least one tang;

a portion of the range being operative to permit the male and female connectors to be uncoupled; and the tapered portion being at least one of shaped and positioned to impede an applied actuation from operating the at least one tang in the operative range portion.

36. The buckle according to claim 32, further comprising a compression latch structure being disengageable by displacement of a latch component and arranged with the at least one resilient tang whereby the at least one resilient tang and the latch component resist displacement to release the engagement until being both subjected to a combined displacement urging force of about 5.5 pounds or greater.

37. The buckle according to claim 36, wherein the combined displacement urging force is about 6.5 pounds or greater.

38. The buckle according to claim 36, wherein the combined displacement urging force is in the range of from about 6.0 pounds to about 16 pounds.

39. The buckle according to claim 36, wherein the combined displacement urging force is in the range of from about 5.5 pounds to about 17.5 pounds.

40. The buckle according to claim 36, wherein the combined displacement urging force is in the range of from about 6.0 pounds to about 10.75 pounds.

41. The buckle according to claim 32, wherein the buckle connectors are composed of an impact modified nylon.

42. The buckle according to claim 32, wherein the buckle has a width dimension greater than or equal to approximately 3 cm.

43. The buckle according to claim 36, wherein the at least one tang is arranged in a coupled buckle such that the combined displacement urging force is applied as a squeezing force over a dimension of about 2 cm to about 3 cm.

44. The buckle according to claim 36, wherein the at least one tang further comprises:

an engagement structure and an operative region on the tapered portion near the engagement structure;

a non-operative region on the tapered portion and farther away from the engagement structure than the operative region; and the tapered portion being shaped to urge an applied disengagement force toward the non-operative region.

45. The buckle according to claim 32, wherein the buckle connectors have walls with a thickness of greater than about 0.07 inches.

46. The buckle according to claim 36, wherein the buckle connectors are composed of an impact modified nylon.

47. The buckle according to claim 45, wherein the buckle connectors are composed of an impact modified nylon.

48. The buckle according to claim 43, wherein the buckle connectors have walls with a thickness of greater than about 0.07 inches.

49. The buckle according to claim 36, further comprising:

a range of movement of the at least one tang;

a portion of the range being operative to permit the buckle connectors to be uncoupled; and the tapered portion on the at least one tang being shaped or positioned to impede an applied actuation from operating the at least one tang in the operative range portion.

50. The buckle according to claim 32, wherein the elongated notch further comprises:

an edge arranged to cooperatively engage the at least one tang; and the at least one tang being urged against the edge of the elongated notch in an engaged position to thereby preload the at least one tang against the displacement urging force.

51. A child resistant buckle, comprising:

a first and second connector shaped to permit the connectors to mate with each other;

a pair of latch elements in one of the first and second connectors and a pair of cooperative catch elements in the other of the first and second connectors, each latch and catch element being respectively cooperative to clasp the buckle when the connectors are mated;

the latch and catch elements being displaceable simultaneously together against a resistance to disengage the latch and catch elements to unclasp the buckle, the resistance being greater than a displacement force capable of being exerted by a child aged 48 months or less the resistance being a force of about 5.5 pounds or greater;

one or more of the connectors having a structural support with a dimension sufficient to maintain sufficient structural integrity to maintain the operative feature when the one or more connectors is subjected to a given force; and the connectors being composed of impact modified nylon.

52. The buckle according to claim 51, wherein the structural support includes one or more walls having a thickness of about 0.07 inches or greater.

53. A child resistant buckle, comprising:

a buckle connector having a first pair of latch members;

another buckle connector having a second pair of latch members operable to respectively cooperate with the first pair to couple the buckle connectors when the first and second pairs of latch members respectively cooperate;

the buckle connectors being uncoupled by displacement of both of the latch members of the first or second pair against a combined urging resistance of about 5.5 pounds or greater provided by a construction and arrangement of one or more of the latch members of the first or second pair; and a shape or position of the one or more latch members of the first or second pair, in combination with the urging resistance, contributing to resist operative action by a child aged about 48 months or less.

54. The buckle according to claim 53, further comprising:

a non-operative region of one or more of the respectively cooperative first and second pair of latch members in which the one or more of the respectively cooperative latch members is not substantially displaced when a displacement force sufficient to overcome the urging resistance is applied in the non-operative region;

an urging portion on the one or more of the respectively cooperative latch members located at an actuation position, whereby the displacement force being applied at the urging portion against the urging resistance tends to be directed along the urging portion toward the non-operative region.

55. A child resistant seat belt buckle, comprising:

a first buckle connector including a latch receptacle for receiving a latch arm;

a second buckle connector including the latch arm being receivable in the latch receptacle to couple the first and second buckle connectors together;

the first and second buckle connectors being uncoupled through displacement of the latch arm away from the latch receptacle to disengage the latch arm and latch receptacle; and the latch arm having a construction to enable the latch arm to resist displacement until subjected to a displacement urging force of about 5.5 pounds or greater.

56. The buckle according to claim 54, wherein the displacement force is in the range of from about 5.5 pounds to about 17.5 pounds.

57. The buckle according to claim 54, further comprising:

an engagement structure on the latch arm and an operative region on a tapered portion near the engagement structure;

a non-operative region on the tapered portion and farther away from the engagement structure than the operative region; and the tapered portion being shaped to urge the displacement urging force toward the non-operative region.

58. The buckle according to claim 54, wherein the latch receptacle further comprises:

an edge arranged to cooperate with the latch arm to engage the latch arm and latch receptacle; and a relationship between the latch arm and the latch receptacle wherein the latch arm is urged against the edge of the latch receptacle in an engaged position to thereby preload the latch arm against the displacement urging force.

59. A child resistant seatbelt buckle, comprising:

a buckle connector having a first latch member;

another buckle connector having a second latch member operable to cooperatively engage with the first latch member to couple the buckle connectors together when the first and second latch members cooperate;

the buckle connectors being uncoupled through displacement of one or more of the latch members away from each other; and a construction of the one or more latch members enabling resistance to the displacement until subjected to a displacement urging force of about 5.5 pounds or greater.

60. The buckle according to claim 59, wherein the displacement force is in the range of from about 5.5 pounds to about 17.5 pounds.

61. The buckle according to claim 59, further comprising:

a range of movement of the one or more latch members;

a portion of the range being operative to permit the buckle connectors to be uncoupled; and a tapered portion on the one or more latch members being shaped or positioned to impede an applied disengagement force from operating the one or more latch members in the operative range portion.

62. The buckle according to claim 59, wherein the construction of the one or more latch members further comprises:

an edge arranged to cooperate with the other of the one or more latch members to contribute to permitting the first and second latch members to be cooperatively engaged; and the one or more latch members being urged against the edge in an engaged position to thereby preload the one or more latch members against the displacement urging force.

63. A child resistant buckle, comprising:

a female connector including an opening on one end and a female latch component;

the female latch component including an elongated notch in an outer surface of the female connector, the elongated notch including a floor and a wall adjoining the floor for defining a portion of the notch and a through slot in the floor of the elongated notch;

a male connector receivable in the opening of the female connector and including at least one resilient tang that includes a moveable end and a tapered portion extending from the moveable end and the at least one tang being releasably receivable for engagement in the slot when the female and male connectors are coupled such that the moveable end, floor and wall form a perimeter of another notch smaller than the elongated notch; and the moveable end being displaceable in a disengaging action in the another notch without disengaging the at least one tang.

64. The buckle according to claim 63, wherein the tapered portion contributes to urging a displacement force in the disengagement action toward the non-operative area to contribute to preventing uncoupling of the male and female connectors by a child.

65. The buckle according to claim 63, further comprising:

an engagement structure on the at least one tang and an operative region on the tapered portion near the engagement structure;

a non-operative region on the tapered portion and farther away from the engagement structure than the operative region; and the tapered portion being shaped to urge a displacement force in the disengaging action toward the non-operative region.

66. The buckle according to claim 63, further comprising a resistance enabling structure on the at least one resilient tang whereby the at least one resilient tang resists displacement to release the engagement until subjected to a displacement urging force of about 5.5 pounds or greater.

67. The buckle according to claim 66, wherein the displacement urging force is in the range of from about 5.5 pounds to about 17.5 pounds.

68. The buckle according to claim 66, wherein the elongated notch further comprises:

an edge arranged to cooperatively engage the at least one tang; and the at least one tang being urged against the edge of the elongated notch in an engaged position to thereby preload the at least one tang against the displacement urging force.

* * * * *